US010123646B2

(12) United States Patent
Fabrizi

(10) Patent No.: US 10,123,646 B2
(45) Date of Patent: Nov. 13, 2018

(54) CHRISTMAS TREE STAND WITH BUILT-IN TARP, APPARATUS AND METHOD OF USE

(71) Applicant: Daniel Fabrizi, Garden City, NY (US)

(72) Inventor: Daniel Fabrizi, Garden City, NY (US)

( * ) Notice: Subject to any disclaimer, the term of this patent is extended or adjusted under 35 U.S.C. 154(b) by 529 days.

(21) Appl. No.: 14/986,679

(22) Filed: Jan. 2, 2016

(65) Prior Publication Data

US 2016/0192799 A1 Jul. 7, 2016

Related U.S. Application Data

(60) Provisional application No. 62/099,455, filed on Jan. 3, 2015.

(51) Int. Cl.
*F16M 13/00* (2006.01)
*A47G 33/12* (2006.01)

(52) U.S. Cl.
CPC ..... *A47G 33/1213* (2013.01); *A47G 33/1206* (2013.01); *A47G 2033/1293* (2013.01)

(58) Field of Classification Search
CPC ..... A47G 33/00; A47G 33/126; A47G 33/045
See application file for complete search history.

(56) References Cited

U.S. PATENT DOCUMENTS 1,372,777 A * 3/1921 Samuel ..... A47G 33/126 248/522
3,872,906 A * 3/1975 Bolanz ..... A47G 33/045 206/423
4,206,795 A * 6/1980 Regan ..... A47G 33/045 206/303
6,808,071 B2 * 10/2004 Brown ..... A47G 33/06 108/90
8,132,360 B2 * 3/2012 Jin ..... A47G 33/126 47/40.5

* cited by examiner

*Primary Examiner* — Amy J. Sterling
(74) *Attorney, Agent, or Firm* — Carrie Stroup

(57) ABSTRACT

A Christmas tree stand, with a watering spout, comprising: a tree stand apparatus with a build-in tarp that is unrolled from the stand when the tree is to be discarded. The stand comprises: a hollow frusto-conical-like shaped housing covered with a hinged collar that is used to pivot the tree to the floor. The housing further comprises: a rotating wheel with spurs in the base; and a rotating cylinder with baffles connected on the cylinder's top edge. A cable lays on the top of the baffles and against the outer sidewall of the rotating cylinder. The cable also runs between three evenly spaced sets of restraints with screws aligned perpendicularly into the tree trunk. When a tree trunk is placed in the rotating cylinder, atop the wheel, and rotated clockwise, then cable pulls the screws against the trunk, and the tree is then locked into place with a foot pedal.

18 Claims, 10 Drawing Sheets

CHRISTMAS TREE STAND WITH BUILT-IN TARP, APPARATUS AND METHOD OF USE

PRIORITY CLAIM

This application claims priority to U.S. Provisional Patent Application Ser. No. 62/099,455 filed on Jan. 3, 2015 and incorporated herein in its entirety by this reference thereto.

FIELD OF THE DISCLOSURE

In general, the present invention relates to an apparatus for displaying Christmas trees. In particular, the present disclosure is a Christmas tree stand apparatus for use with live trees, and comprising a built-in tarp that is used to roll the tree up when it is discarded.

BACKGROUND OF THE DISCLOSURE

Live Christmas trees shed needles, especially after the tree has been cut and on display for a few weeks during the holiday season. This shedding makes it especially bothersome when a user needs to dismantle the tree from the stand, and dispose of the tree. Needles are spread throughout the area that the tree stood and where it is disassembled. To prevent this, the user may use a tarp to wrap the tree in, if there is one on hand.

What is needed is a Christmas tree stand that will: easily adjust to the size of a wide variety of tree trunk diameters and uneven bases; is easy to water without spilling fluids in the area around the stand; and that has a built-in disposable tarp (e.g. made of recycled plastic) to facilitate dismantling the tree by catching the shedding needles. The apparatus of the present disclosure comprises all of these features.

SUMMARY OF THE DISCLOSURE

The various embodiments of the present disclosure comprise a Christmas tree stand with a built-in tarp that is unrolled from the stand when the tree is to be discarded. The stand comprises: a hollow frusto-conical-like shaped housing covered with a hinged collar that pivots the tree to the floor when the tree is to be discarded. The housing further comprises: a rotating wheel with spurs in the base; and a rotating cylinder with baffles connected on the cylinder's top edge. A cable lays on the top of the baffles and against the outer sidewall of the rotating cylinder. The cable also runs between three evenly spaced sets of restraints with screws aligned perpendicularly into the tree trunk. When a tree trunk is placed in the rotating cylinder and rotated clockwise, the cable pulls the screws and restraints against the trunk to stabilize it, and the tree is locked into place with a foot pedal. The screws may also be manually rotated to further embed them into the tree trunk. Additionally, the locking pedal further comprises a hole for facilitating pouring water into the apparatus from a bottle without spilling the water.

The method of assembling comprises the following steps of: inserting the tree trunk into the housing, centered in the rotating cylinder, and pressing downward to embed the spurs of the rotating wheel into the trunk bottom. Then rotating the trunk clockwise up to about ninety degrees, which concurrently causes the cylinder and wheel to rotate clockwise. This in turn causes the cable to tighten around the rotating cylinder and pull the connected screws perpendicularly into the tree bark. Pressing downward on the foot pedal locks the cylinder, wheel, and cable in place. The user may then manually turn the screws to further stabilize the tree's vertical position within the apparatus.

The method of disassembling comprises the steps of: pulling on the ends of the tarp to unroll it from the housing, and unfolding the tarp to lay on the ground while still being connected on one end to the housing. Unlocking the foot pedal and lowering the tree to the tarp, which causes the rotating cylinder and cable assembly to pivot to a vertical position. Manually loosening the screws and rotating the cylinder counter-clockwise to automatedly retract the screws and restraints. Manually removing the rotating cylinder from the tree trunk, and wrapping the tree within the tarp and sealing the bundle closed with adhesive tape that is affixed along the edge of the tarp.

The method of watering the tree while it is in the stand comprises: screwing an adapter onto the threads of the top of a bottle of water; inserting the adapter with the bottle of water into a hole centered in the locking foot pedal, wherein the bottle is positioned at a downward angle to facilitate pouring water into the stand without spilling any of it.

An object of the present disclosure is a tree stand with a built-in tarp to facilitate disposing of the tree while not having to clean up shedding needles and other debris.

Another object is providing a mechanism to facilitate watering the tree while it is in the stand without spilling the water.

Another object is providing a tree stand that is able to fit a wide range of tree trunk diameters and shapes.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed apparatus. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

Objects, features, and advantages of the invention will be brought out further in the following part of the specification, wherein detailed description is for the purpose of fully disclosing the various embodiments without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 1:
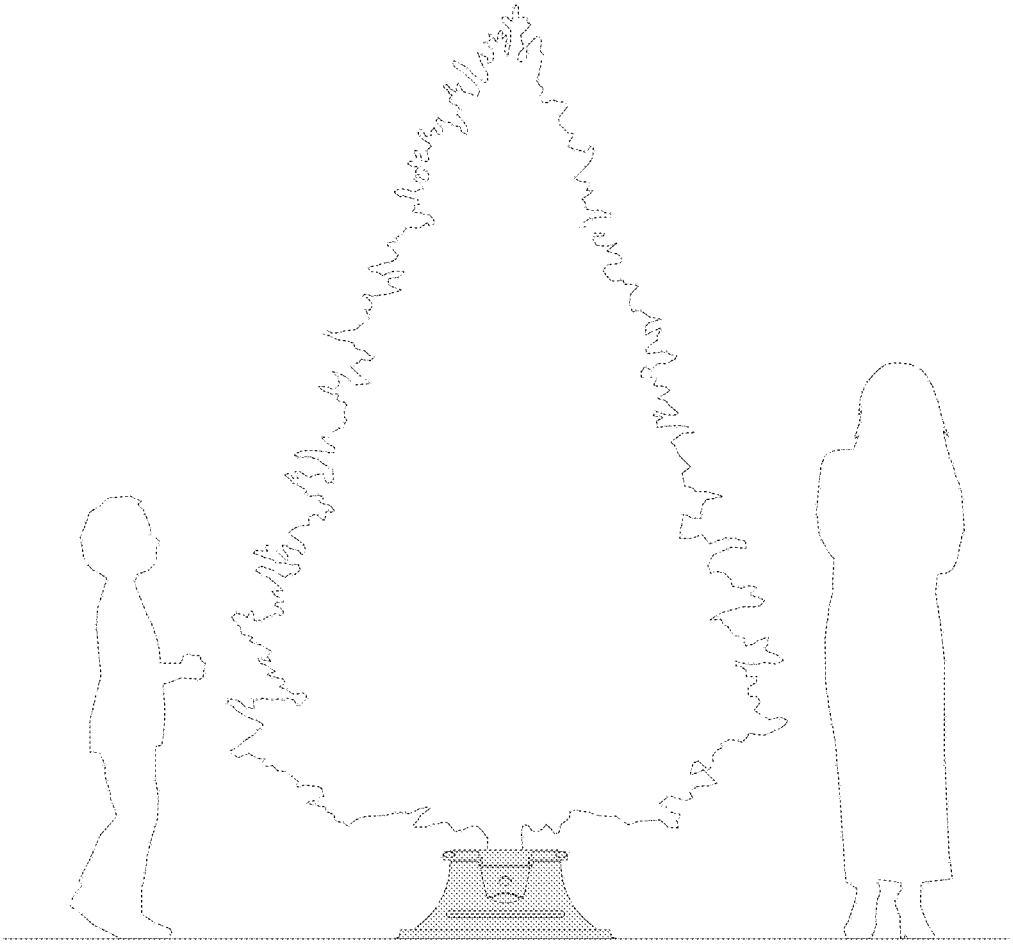
FIG. 1 is a front elevational view of the tree stand apparatus displaying a Christmas tree.
Figure 2:
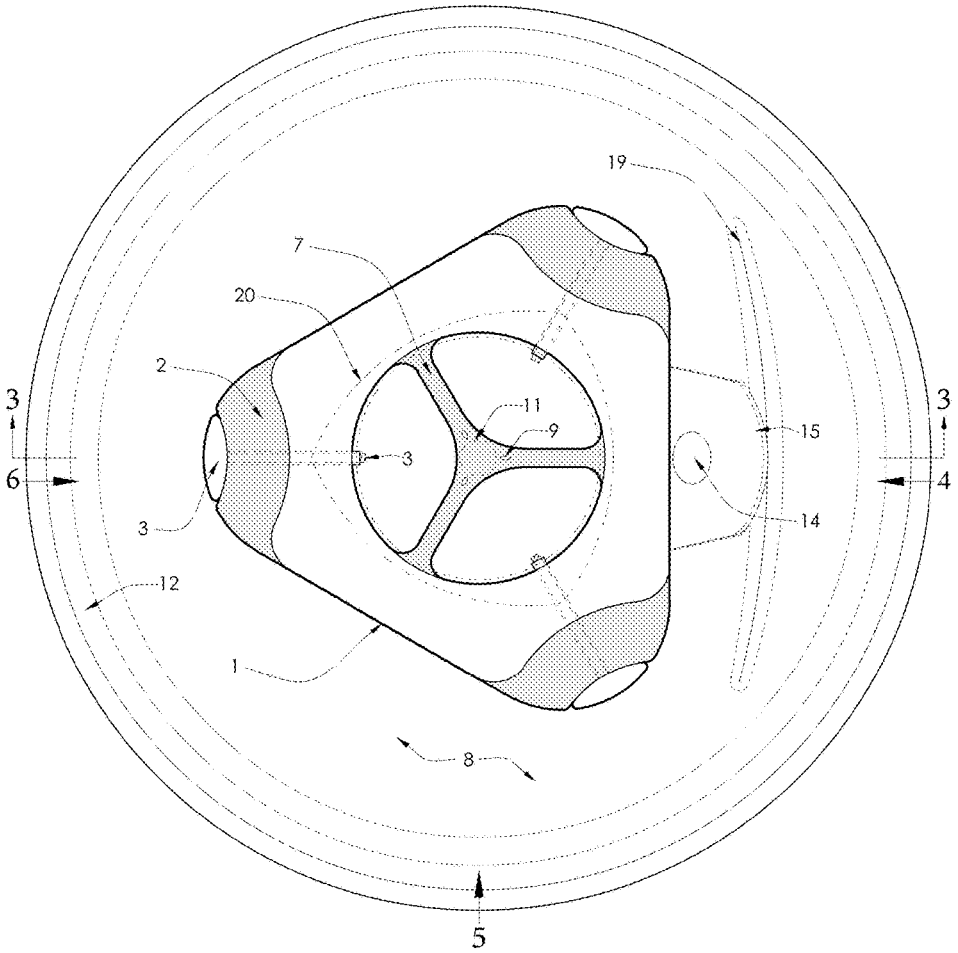
FIG. 2 is a top plan view of the tree stand apparatus without a tree.
Figure 3:
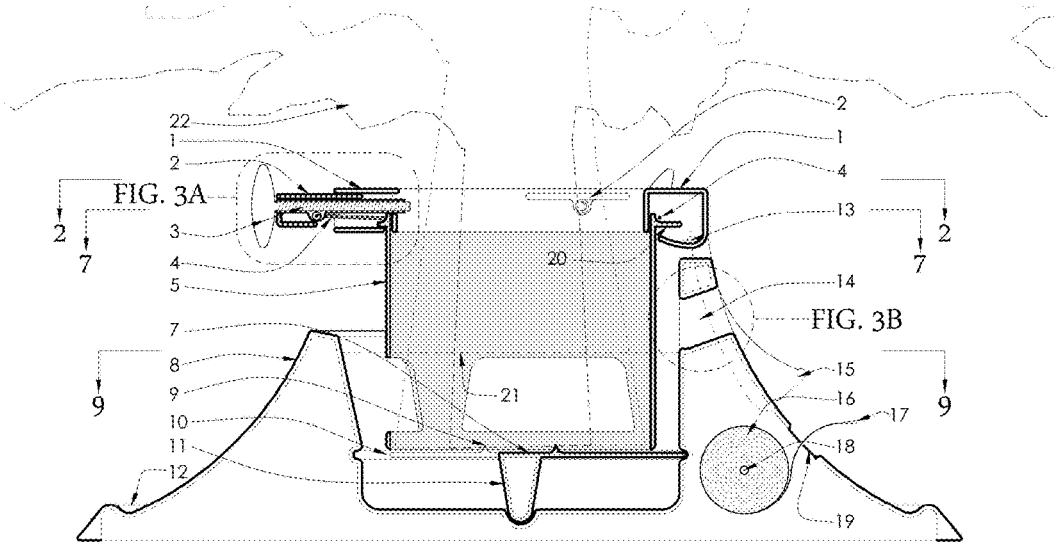
FIG. 3 is a left side elevational view of a cross-section of the tree stand apparatus as it is being assembled with a Christmas tree.
Figure 3A:
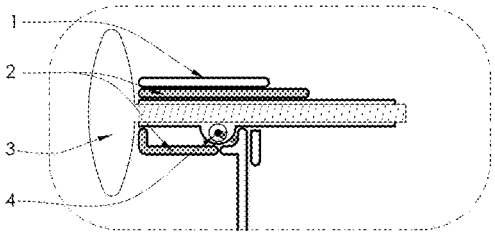
Figure 3B:
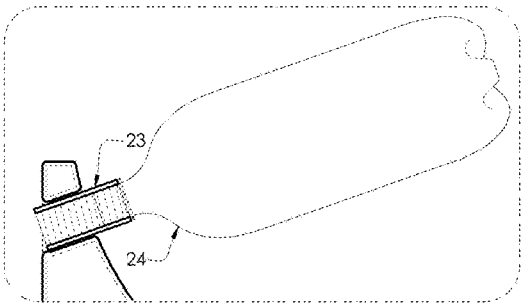
Figure 4:
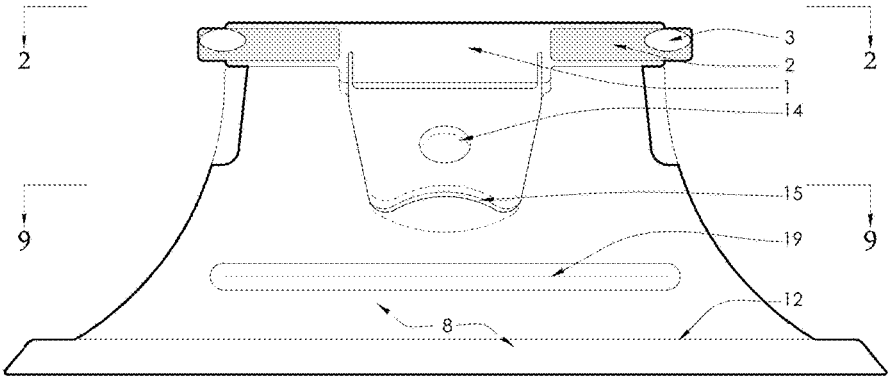
Figure 5:
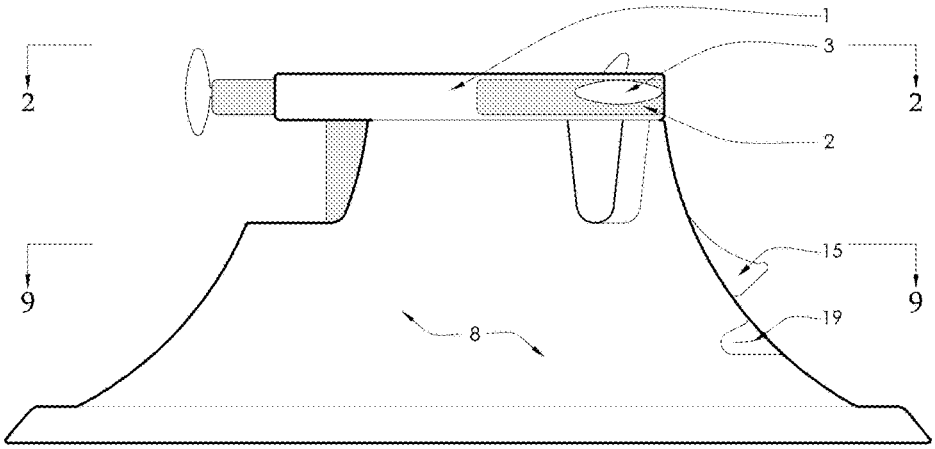
Figure 6:
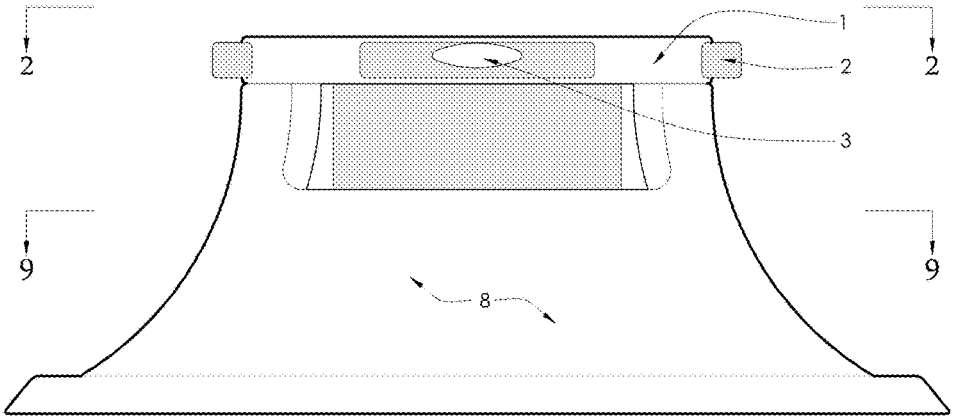
Figure 7:
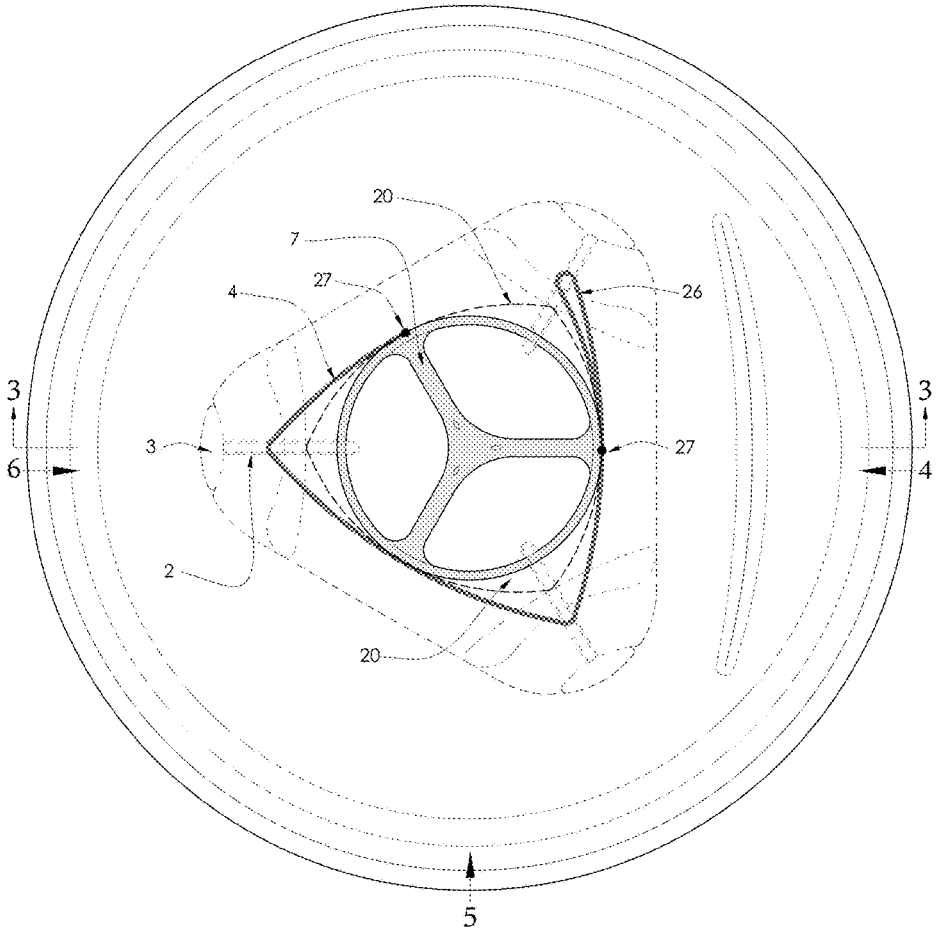
Figure 8:
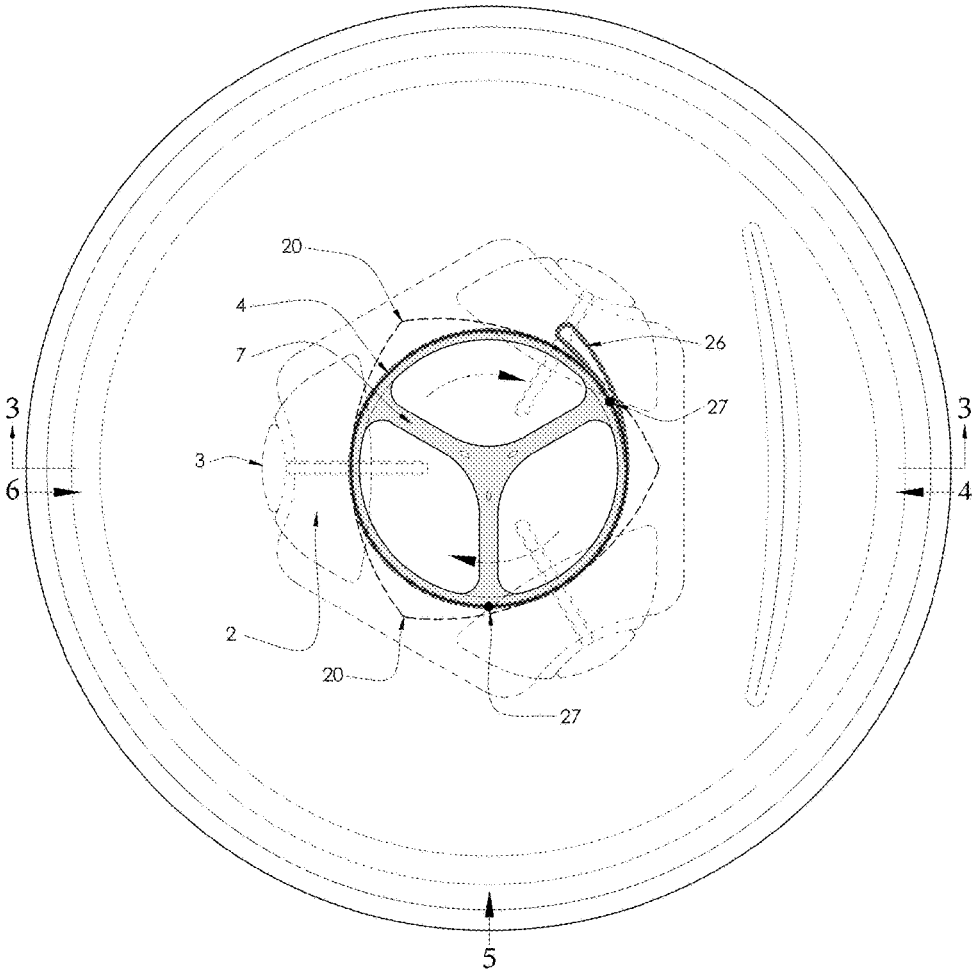
Figure 9:
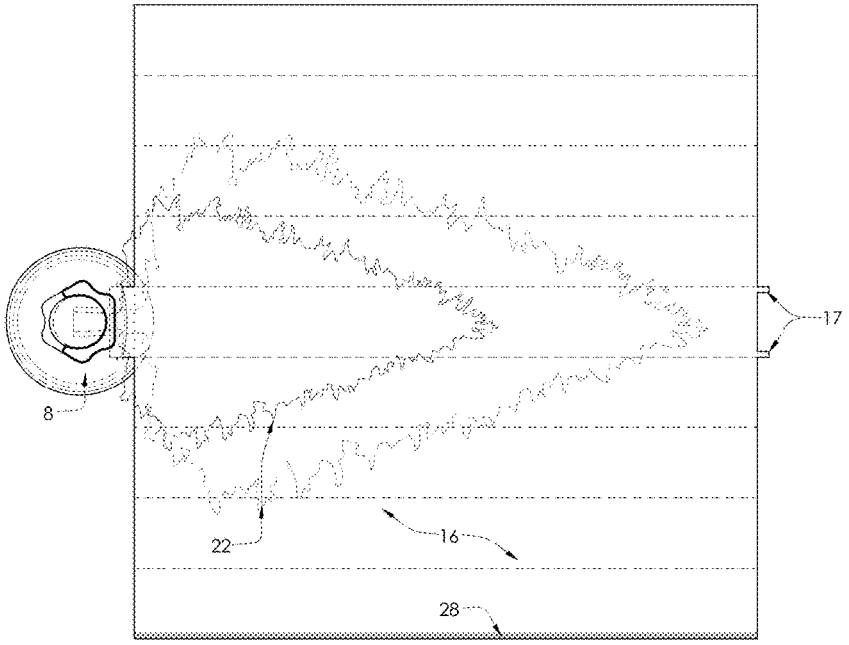
Figure 10:
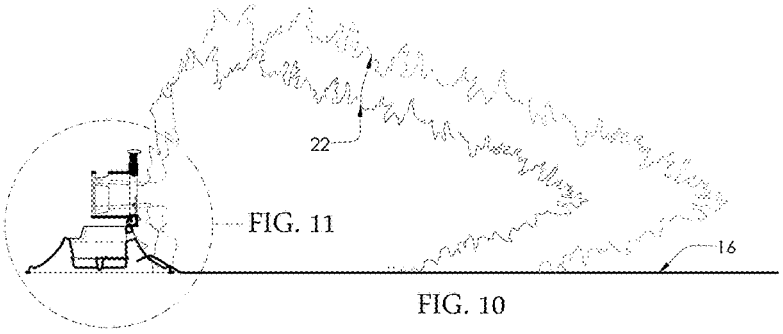
Figure 11:
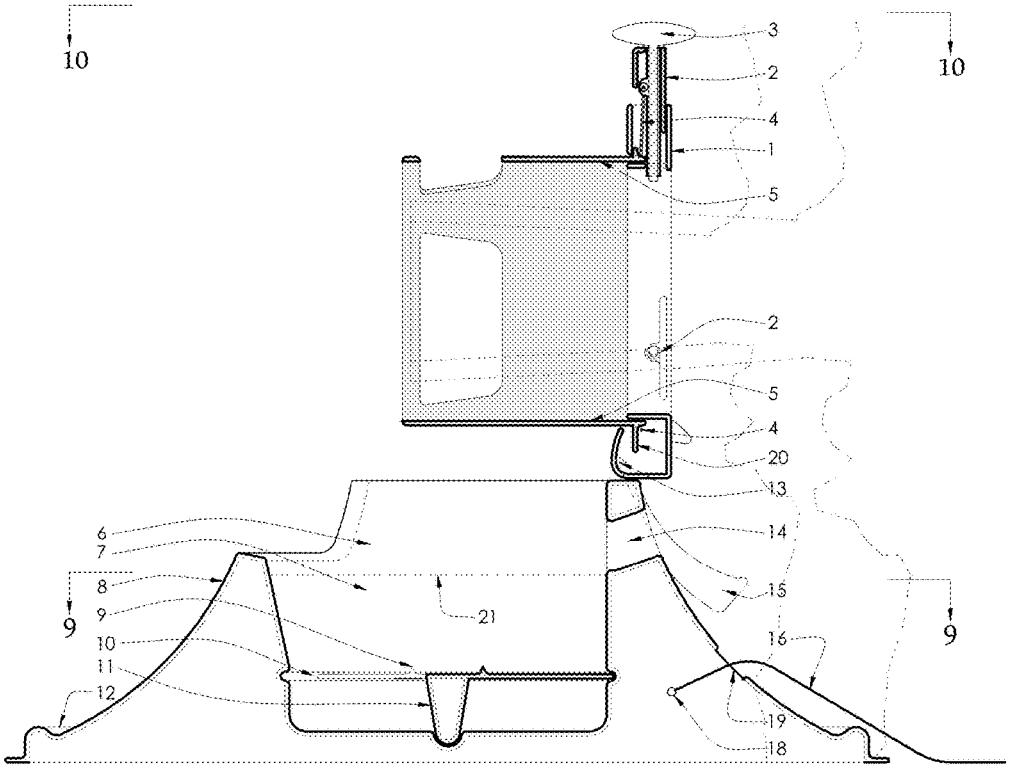

FIG. 3*a* is an expanded view of one of the screw mechanisms of FIG. 3;

FIG. 3*b* is an expanded view of the spout of a water bottle being inserted into the tree stand apparatus at the front opening in FIG. 3;

FIG. 4 is a front elevational view of the tree stand apparatus;

FIG. 5 is a left side elevational view of the tree stand apparatus;

FIG. 6 is a rear elevational view of the tree stand apparatus;

FIG. 7 is a top plan view of the tree stand apparatus with the cable configuration in a retracted position;

FIG. 8 is a top plan view of the tree stand apparatus in a ninety-degree clockwise rotation;

FIG. 9 is a top plan view of the tree stand apparatus, and tree laying on the tarp;

FIG. 10 is a left side elevational view of FIG. 9; and,

FIG. 11 is a left side elevation view of the tree stand apparatus with the hinged collar in the vertical position.

DETAILED DESCRIPTION OF THE PREFERRED EMBODIMENTS OF THE INVENTION

Apparatus and Method of Assembly of Tree within Stand

Now referring to drawings in FIGS. 1-11, wherein similar components are identified by like reference numerals, wherein Table 1 indicates the item number associated with each component of the tree stand.

TABLE 1

| Item No. | Component |
|---|---|
| 1 | Top collar |
| 2 | Gliding restraint for the screws 3 |
| 3 | Screws (total of 3) |
| 4 | Cable |
| 5 | Interlocking upper cylinder |
| 7 | Lower revolving wheel |
| 8 | Hollow frusto-conical shaped housing |
| 9 | Restraining spurs |
| 10 | Cylinder guide |
| 11 | Revolving post |
| 12 | Base of housing 8 |
| 13 | Hinge of collar 1 |
| 14 | Hole in pedal 15 for water adapter 23 |

TABLE 1-continued

| Item No. | Component |
|---|---|
| 15 | Locking foot pedal |
| 16 | Disposable tarp |
| 17 | Tarp hanging end |
| 18 | Tarp spool in housing 8 |
| 19 | Tarp dispensing slot in housing 8 |
| 20 | Triangular shaped baffle of cylinder 5 |
| 21 | Water line within housing 8 |
| 22 | Tree with trunk |
| 23 | Removable adapter |
| 24 | Water bottle spout |
| 26 | Individual gliding restraint-cable looped end |
| 27 | Cable 4 point of attachment |
| 28 | Tarp's exposed adhesive strip |

Tree stand apparatus 100 comprises the outer components of: a substantially hollow frusto-conical-like shaped housing 8 with a hinged collar 1 on the top surface. Housing 8 may further comprise openings in the side wall to enable a user to see within the apparatus 100.

Collar 1 further comprises a circular opening in the center that the tree trunk 22 is inserted into. And collar 1 comprises a hinge mechanism 13 on the front side of apparatus 100 to enable the collar to be rotated 90 degrees upward to a vertical position when the tree is to be discarded. For example, FIG. 3 illustrates a hinge 13 comprising a pin on either side of the collar inset, and a thicker collar surface to facilitate rotating and stabilizing the collar in a vertical position.

Wheel with Spurs:

Apparatus 100 inner components comprise a lower revolving wheel 7 that the tree trunk rests upon when the rotating cylinder 5 is locked into position via the cylinder guide (see FIG. 3, plate 10 that fits into base's indentation). Wheel 7 further comprises a plurality of vertically oriented spurs 9 to embed into the bottom of the tree trunk so that the trunk does not slip when wheel 7 is rotated. The user places the trunk of tree 22 into the fixed hinged collar 1 and the rotating cylinder 5 of apparatus 100, and lowers it until the tree trunk bottom is resting against the plurality of spurs 9 that point vertically upward from wheel 7. Wheel 7 rotation is also facilitated by the wheel resting upon a centered, conical shaped post 11 that extends downward from the wheel.

Rotating Cylinder and Cable Assembly:

Apparatus 100 inner components further comprise a rotating cylinder connected to a cable assembly. As illustrated in the cross sectional left side view of FIG. 3, rotating cylinder 5 is joined to three triangular shaped baffles 20, or ledges, on its top edge. Cable 4 (in the cross sectional view) lays on top of baffles 20 and against the outer sidewall of cylinder 5.

The cable assembly comprises a tightening mechanism to automatedly turn a plurality of horizontally positioned screws 3 into the tree trunk bark. Each tightening mechanism comprises a hollow cylinder gliding restraint 2 within which a screw 3 slides, and wherein a hole extends from each restraint 2 that is of sufficient width to allow a cable 4 to easily pass through. For example, FIG. 3*a* provides an illustration of cable 4 in a cross-sectional view within the hole of restraint 2.

The cable assembly is also viewed from a top plan view in FIGS. 7 and 8. Cable 4 rests on the triangular shaped baffles 20 while encircling cylinder 5 (projecting out of figures) about 300 degrees in the exemplified embodiment. The length of cable 4 and the diameter of cylinder 5 further determine the length of the circumference of cylinder 5 that cable 4 covers. FIG. 7 illustrates cable 4 passing through the hole (not shown) of each of three gliding restraints 2 when the screws 3 are fully retracted, such as before a tree trunk is inserted into the apparatus 100. The three baffles 20 are aligned with the screws 3 when the screws are fully retracted and not touching the tree trunk.

FIG. 8 illustrates each component's position after the wheel 7 and cylinder 5 (projecting out of page and not shown) are rotated 90 degrees clockwise, such as when a tree trunk bottom end is inserted into apparatus 100 and connected with spurs 9. Rotation of wheel 7 and cylinder 5 is forced by the user manually rotating the tree trunk 22 clockwise. This also causes movement of cable 4 clockwise that subsequently pulls the three sets of restraint 2 and screw 3 perpendicularly inward towards a tree trunk (not shown) to affix the trunk vertically within the stand. Baffles 20 likewise rotate 90 degrees clockwise while cable 4 comes to rest against the outer sidewall of rotating cylinder 5 along the cable's entire length.

Additionally, when cable 4 moves as the cylinder 5 rotates, each screw 3 moves independently from the other two screws. As a result, a tree trunk with an uneven outer surface is affixed between the three screws in a stable manner where each of the screws 3 may be extended a different length from their restraint 2 because of the trunk's unevenness. The independent movement of screws also enables apparatus 100 to fit a wide range of tree trunk diameters, such as from about 2.5 inches to about 7 inches.

Locking Foot Pedal:

As illustrated in FIGS. 2, 4, 5, and 11, apparatus 100 further comprises a locking foot pedal 15 for use after the cylinder 5 and wheel 7 are completely rotated. When the user steps on pedal 15, it will rotate to a closed and locked position lying flush with the outer surface of housing 8. The cylinder 5, wheel 7, screws 3 and restraints 2 are no longer able to move, and the tree trunk is locked within the stand apparatus 100. Locking pedal 15 may further comprise: a center hole 14 for watering the tree; an upward curved component, or other structure, to facilitate lifting the pedal with the front tip of a user's shoe; and a hinge connection on the pedal's top surface to pivot the pedal between a locked and unlocked position.

Adjustments:

The amount of tightening and the tree position is adjustable by manually rotating counter-clockwise the tree trunk 22 before depressing the locking pedal 15. The rotation automatedly retracts the restraints 2 and screws 3 outwardly to loosen the tree. Additionally, before and after the locking pedal 15 is depressed, screws 3 can be manually turned by the user to further stabilize the tree within the stand.

Method of Watering Tree

Watering Hole:

As illustrated in FIGS. 3, 3*b*, and 4, locking pedal 15 further comprises a center hole 14 that is angled upward, and of sufficient diameter, to tightly fit an adapter 23 that is affixed onto a bottle comprising a threaded spout. Adapter 23 slides down into hole 14 and allows water and other fluid nutrients from bottle 24 (FIG. 3*b*) to pour into the cylinder 5 until it reaches a desired level for proper plant hydration (see FIG. 3, line 21). Adapter 23's tight fit into hole 14 and onto the bottle spout prevents the fluid and nutrients from leaking onto the floor.

Built-in Tarp Embodiment and Method of Disassembling

Apparatus 100 may further comprise a built-in tarp 16 residing on a roller 18 within housing 8. As illustrated in FIGS. 3, 9, and 10, tarp 16 is unrolled by pulling on the tarp end(s) 17 hanging from spool 18, that extends out of housing 8 via slot 19. As shown in FIG. 9, once the tarp 16 is unrolled from the housing 8, it is unfolded and laid on the ground while one end is still attached to housing 8 at slot 19.

The tree stand apparatus 100 is then disassembled by: unlocking pedal 15 by lifting it at the hinge 13; and then rotating the tree downward to lay on the floor while the cylinder 5 and cable assembly rotate out of housing 8 and into a vertical position (e.g. see FIGS. 10 and 11). Next, the user manually loosens screws 3 and rotates cylinder 5 counter-clockwise to retract restraints 2. The user then pulls tree 22 free from the apparatus 100 by removing cylinder 5, with the cable assembly and collar 1, from the tree trunk. The ends of tarp 16 are then folded over the tree and sealed shut with the adhesive tape end 28 that extends along one or both borders of the tarp. The disposable tarp (e.g. made of recyclable plastic) and tree may then be thrown into the trash without littering the ground with tree needles while transporting the tree.

CONCLUSION

It is additionally noted and anticipated that although the apparatus is shown in its most simple form, various components and aspects of the apparatus may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention or claims herein. Consequently, all such modifications and variations and substitutions are included within the scope of the invention as defined by the following claims.

What is claimed is:

1. A method of assembling and disassembling a Christmas tree in a stand apparatus, comprising:

a. providing a stand apparatus comprising:
   - a housing comprising a frusto-conical shape;
   - a hinged collar able to pivot to a vertical position and covering the housing;
   - a rotating cylinder and a cable assembly positioned beneath the hinged collar within the housing;
   - a rotating wheel near a bottom of and within the housing;
   - a built-in tarp that is unroll-able from within the housing;

b. inserting a tree trunk into the housing, centered in the rotating cylinder, and resting on the rotating wheel; and c. rotating the tree trunk, cylinder and wheel clockwise up to about ninety degrees to cause the cable assembly to tighten around the rotating cylinder and stabilize the tree trunk within the stand apparatus.

2. The method of claim 1, wherein the cable assembly further comprises a plurality of screws, each screw slide-able within a hollow horizontally positioned cylindrical restraint.

3. The method of claim 1, wherein the cable assembly further comprise a cable connected to each of the restraints, wherein rotating the cylinder tightens the cable and pulls the screws perpendicularly into the tree trunk.

4. The method of claim 2, wherein the apparatus housing further comprises a foot pedal able to lock the rotating wheel, cylinder and cable assembly into position to stabilize the tree trunk.

5. The method of claim 1, further comprising manually turning the screws to further stabilize the tree trunk within the apparatus.

6. The method of claim 1, wherein the rotating wheel further comprises a plurality of vertically pointing spurs able to embed into the trunk and rotate the wheel with the tree without slippage.

7. The method of claim 3, wherein the housing further comprises a spool of tarp and a slot for unspooling the tarp from the housing.

8. The method of claim 3, wherein the locking pedal further comprises a hole for facilitating pouring water into the apparatus from a bottle without spilling the water.

9. The method of claim 6, wherein disassembling the apparatus comprises:

a. unspooling and unfolding the tarp to lay on a ground while still being connected on one end to the housing;
b. unlocking the foot pedal and lowering the tree to the tarp, which causes the rotating cylinder and cable assembly to pivot to a vertical position;
c. rotating the cylinder counter-clockwise to automatedly retract the screws and restraints;
d. manually removing the rotating cylinder and hinged collar from the tree trunk; and
e. wrapping the tree within the tarp and sealing the tarp closed with an adhesive tape that is affixed along the edge of the tarp.

10. A Christmas tree stand apparatus comprising:

a. a housing comprising a frusto-conical shape;
b. a hinged collar able to pivot to a vertical position and covering the housing;
c. a rotating cylinder and a cable assembly positioned beneath the collar within the housing;
d. a rotating wheel near a bottom of and within the housing; and
e. a built-in tarp that is unroll-able from within the housing.

11. The Christmas tree stand apparatus of claim 10, wherein the cable assembly further comprises a plurality of screws, each screw slide-able within a horizontally positioned hollow cylindrical restraint.

12. The Christmas tree stand apparatus of claim 11, wherein the cable assembly further comprises a cable connected to each of the restraints, and wherein rotating the cylinder tightens the cable and pulls the screws perpendicularly into a trunk of the tree.

13. The Christmas tree stand apparatus of claim 12, wherein each restraint comprises a hole extending downward for the cable to slide horizontally through.

14. The Christmas tree stand apparatus of claim 13, wherein the cable is positioned to slide through the holes when the rotating cylinder is rotated and to cause the screws to move perpendicularly into the tree trunk.

15. The Christmas tree stand apparatus of claim 10, wherein the apparatus housing further comprises a foot pedal able to lock the rotating wheel, cylinder and cable assembly into position to stabilize the tree trunk.

16. The Christmas tree stand apparatus of claim 10, wherein the rotating wheel further comprises a plurality of vertically pointing spurs able to embed into the trunk and rotate the wheel with the tree without slippage.

17. The Christmas tree stand apparatus of claim 10, wherein the housing further comprises a spool of tarp and a slot for unspooling the tarp from the housing.

18. The Christmas tree stand apparatus of claim 11, wherein the locking pedal further comprises a hole for facilitating pouring water into the apparatus from a bottle without spilling the water.

* * * * *